US009498049B2

(12) United States Patent
Besche

(10) Patent No.: US 9,498,049 B2
(45) Date of Patent: Nov. 22, 2016

(54) ELASTIC CASING ARTICLE HOLDER

(75) Inventor: Charles F. Besche, Severna Park, MD (US)

(73) Assignee: Charles F. Besche, Severna Park, MD (US)

( * ) Notice: Subject to any disclaimer, the term of this patent is extended or adjusted under 35 U.S.C. 154(b) by 515 days.

(21) Appl. No.: 12/806,943

(22) Filed: Aug. 24, 2010

(65) Prior Publication Data

US 2011/0049202 A1 Mar. 3, 2011

Related U.S. Application Data

(60) Provisional application No. 61/275,551, filed on Sep. 1, 2009.

(51) Int. Cl.

| | |
|---|---|
| ***A45F 5/00*** | (2006.01) |
| ***A45F 5/02*** | (2006.01) |
| ***B63C 11/02*** | (2006.01) |
| *B63C 11/52* | (2006.01) |

(52) U.S. Cl.

CPC ..... *A45F 5/00* (2013.01); *A45F 5/021* (2013.01); *B63C 11/02* (2013.01); *A45F 2200/0566* (2013.01); *B63C 11/52* (2013.01); *Y10T 279/17153* (2015.01); *Y10T 279/34* (2015.01)

(58) Field of Classification Search

USPC ..... 224/251, 904, 914–915, 255; D3/229; 294/150; 221/307–308; 411/519, 907; 277/615; 285/123.12, 123.3, 123.6; 403/109.1, 109.2, 220, 226, 377

See application file for complete search history.

(56) References Cited

U.S. PATENT DOCUMENTS

| | | | | |
|---|---|---|---|---|
| 1,150,483 | A * | 8/1915 | Barber | 464/57 |
| 2,758,762 | A * | 8/1956 | Medley | 224/243 |
| 2,866,440 | A * | 12/1958 | Green | 434/166 |
| 2,943,875 | A * | 7/1960 | Reichert | 403/226 |
| 3,122,806 | A * | 3/1964 | Lewis | 403/220 |
| 3,143,265 | A * | 8/1964 | Ruderian | 294/142 |
| 3,435,987 | A * | 4/1969 | Salcman et al. | 221/307 |
| 3,558,144 | A * | 1/1971 | Corbett et al. | 277/615 |
| 4,706,367 | A * | 11/1987 | Garringer | 29/525.05 |
| 4,858,784 | A * | 8/1989 | Moody | 221/155 |
| 5,038,970 | A * | 8/1991 | Chich | 221/307 |
| 5,060,996 | A * | 10/1991 | Garnes | 294/19.2 |
| 5,199,750 | A * | 4/1993 | Yang | 285/231 |
| 5,644,832 | A * | 7/1997 | Kanao | 29/458 |
| 5,913,557 | A * | 6/1999 | Jarock | 294/15 |
| 6,398,072 | B1 * | 6/2002 | Nitta et al. | 221/307 |
| 6,474,519 | B1 * | 11/2002 | Cleveland | 224/251 |
| 7,901,169 | B2 * | 3/2011 | Slocum | 410/97 |

* cited by examiner

*Primary Examiner* — Nathan J Newhouse
(74) *Attorney, Agent, or Firm* — Hauptman Ham, LLP

(57) ABSTRACT

A holder for the shank of a tool comprising a cylinder having a series of shoulders and grooves in radial formation with the shoulders and grooves allowing for O-rings to penetrate to the interior and exterior of the cylinder to form a means whereby the shank of a tool can be inserted and the tool held in position. As an alternative embodiment the shoulders and grooves can be helical around the cylinder with rubber latex tubing in the grooves and penetrating to the interior and exterior of the cylinder to thereby hold a tool or implement. Also note that a tool can be inserted at either end of the cylinder; and that an oversize cylinder can be inserted over the cylinder and held by the exterior portion of the O-ring or latex tubing.

A special embodiment of this invention is the formation of a grommet employing a tubular portion to form a ring into which is cut grooves forming shoulders and into which is inserted an O-ring to form a grommet.

10 Claims, 12 Drawing Sheets

ELASTIC CASING ARTICLE HOLDER

CROSS REFERENCE TO RELATED APPLICATION

This application is related to Provisional Patent Application Ser. No. 61/275,551 dated Sep. 1, 2009.

BACKGROUND OF THE INVENTION

1. Field of the Invention

The invention finds applicability in the field of devices for holding tools. In particular the invention relates to workers in extreme environments and the means to attach tools for commercial, military, law enforcement, rescue and other special operations. Besides being used in scuba diving, the device would be useful in other types of extreme environments such as space exploration, mining and other cramped-space locals. The invention also provides means to attach tools in commercial, military and rescue operations.

Workers in hazardous environments such as scuba divers, have difficulty handling tools due to protective and restrictive equipment required to be worn or carried. A tool used for a special task in abnormal circumstances must be safely secured and be quickly accessible. It is advantageous if a tool can be removed and reset in its holding place easily. Conventional tool sheaths without latches or clasps do not function well when inverted. Conventional tool holders with latches or clasps are difficult to release and refasten when used with restrictive gear in demanding environments. A device that secures a tool and has no mechanism which must be opened or released would be beneficial. Such a device would enable persons in extreme environments to access and stow a tool more effectively.

A basic unit of this invention finds applicability as a grommet or bushing.

2. Description of Related Art

The following relevant references are made of record.

Grevich et al (U.S. Pat. No. 3,819,194) is for a flexible tube holder. The reference shows a spring (not an O-ring) for holding a tube. The spring grabs from the inside, but does not grab from the outside. The reference does not show a simple plastic casing with the O-ring in an internal triangular configuration. This triangular configuration would be stronger than the square one of the reference.

Resina (U.S. Pat. No. 2,593,794) is for a cap-securing chuck. The chuck has a triangular spring to hold the cap within the chuck. The reference uses a spring rather than an O-ring. The spring does not protrude to the exterior of the shaft as our O-ring would.

Stern (U.S. Pat. No. 6,910,578) is for a tool accessory holder which uses a magnet to secure the tool accessory. No O-ring or elastic coil is employed.

McNab et al (U.S. Pat. No. 6,027,151) disclose a utensil holder employing a plurality of interconnected coils for wrapping around the stem of a utensil or other instrument for facilitating manual gripping. The inner diameter of the coil is expandable upon the twisting of the utensil holder into the coils. While McNab et al teach plastic interconnected coils around a utensil handle, there is missing from McNab et al the concept of the instant invention; that is that no plastic casing is shown which retains the elastic coil which in turn retains a tool. Nor does McNab et al show a casing which is able to grip and retain an article both inside and outside of the casing.

Kenney (U.S. Pat. No. 3,096,960) discloses a device for retaining long handled implements; e.g., brooms and mops and uses internal flexible tips or projections to retain the article.

BRIEF SUMMARY OF THE INVENTION

The invention involves two separate embodiments. Each of these embodiments involves a tool holding cylindrical device which holds the rod or shaft of a tool inserted into the cylinder. The cylinder is made of Polyvinyl Chloride (PVC) pipe or the like material. Each cylinder of the tool holding device is supplied with a series of parallel circular grooves cut through the surface and into the interior of the PVC pipe. Bands or coils which when installed into the grooves and over the shoulders around the cylinder penetrate to the inside of the cylinder. Three columns of parallel grooves create channels in the pipe, which when fitted with elastic bands or coils grip an inserted rod or shaft of a tool on three sides. The columns of elastic material create triangular opposing walls within the cylinder pipe-casing which will exert equal pressure on the rod or shaft inserted therein. The bands or coils which penetrate to the inside protrude on the outside of the casing supplying a means whereby oversized tubing can be placed over the bands or coils which protrude to the outside and the oversized tubing held in place (FIG. 12), so that two ends of tubing can be joined, e.g., by welding. These embodiments will be identified as the O-ring or band-utilizing embodiment and the coil-utilizing embodiment; and they will be described separately below.

A special embodiment of this invention is using an elemental unit of the O-ring elastic casing to create a grommet or bushing, as described below.

OBJECT OF THE INVENTION

An object of the invention is to control lateral, linear and rotational movement of a rod or shaft inserted into the tool holding device.

Another object of the invention is to produce a tool-holding device able to receive, hold and release a tool with ease.

A further object of the invention is to produce a tool holder able to receive the shank of a tool either from the top or bottom of the tool holder.

A still further object of the invention is to produce a tool holder useful in scuba diving and extreme environments.

An important object of this device is to produce a holder which will hold two pieces of tubing in order to align or join their ends.

A special object of this invention is to use a cut portion of the O-ring casing to form a grommet or bushing.

These and other objects of the present invention will become apparent from a reading of the following specification taken in conjunction with the enclosed drawings.

DEFINITIONS

The following expressions in this patent are intended to be used interchangeably:

1) rod: shaft: shank
2) casing: pipe casing: cylinder
3) O-ring: band
4) ribbon: coil: latex tubing
5) elemental unit: grommet base
6) grommet: bushing: spacer

DESCRIPTION OF THE INVENTION

O-Ring or Band-Utilizing Embodiment

Figure 5:
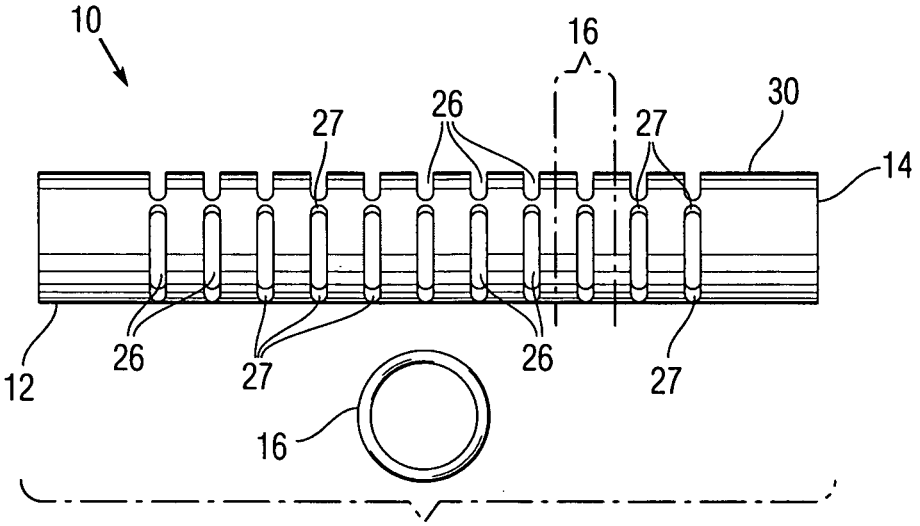
FIG. 5 is a top plan view the casing base to be used with the O-ring to make the O-ring, Elastic Casing Article Holder.
Figure 6:
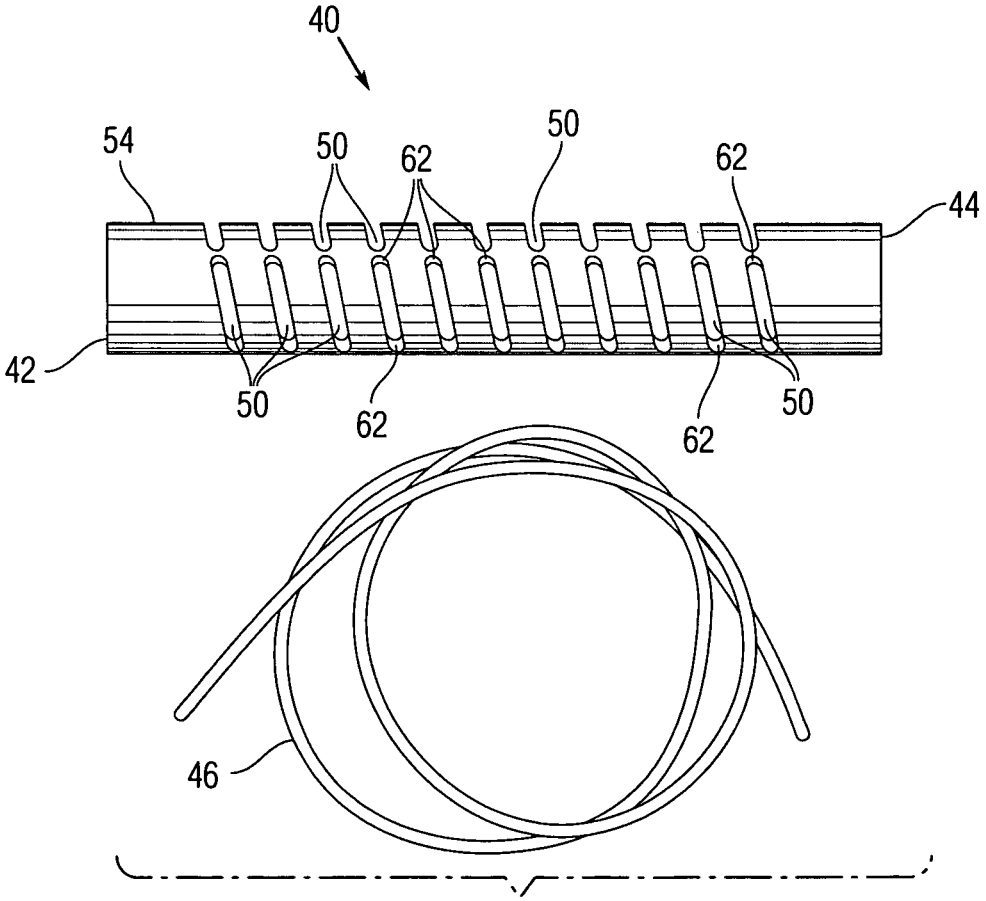
FIG. 6 is a top plan view of the casing base to be used with a coil to make the Helical Coil Elastic Casing Article Holder.
Figure 7:
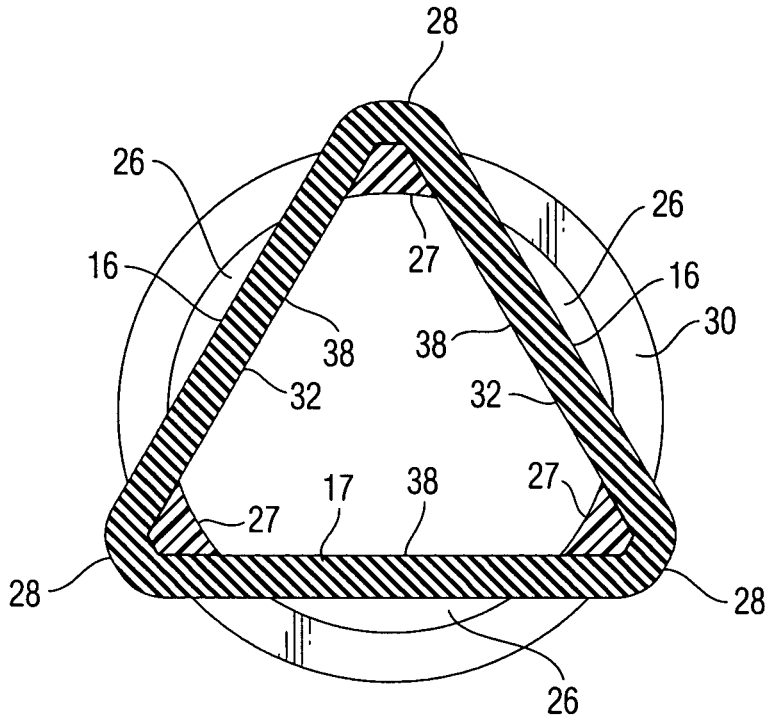
FIG. 7 is a cross-section along lines 7-7 of FIG. 2 to show the inner portion of the O-ring Elastic Casing Article Holder.
Figure 9:
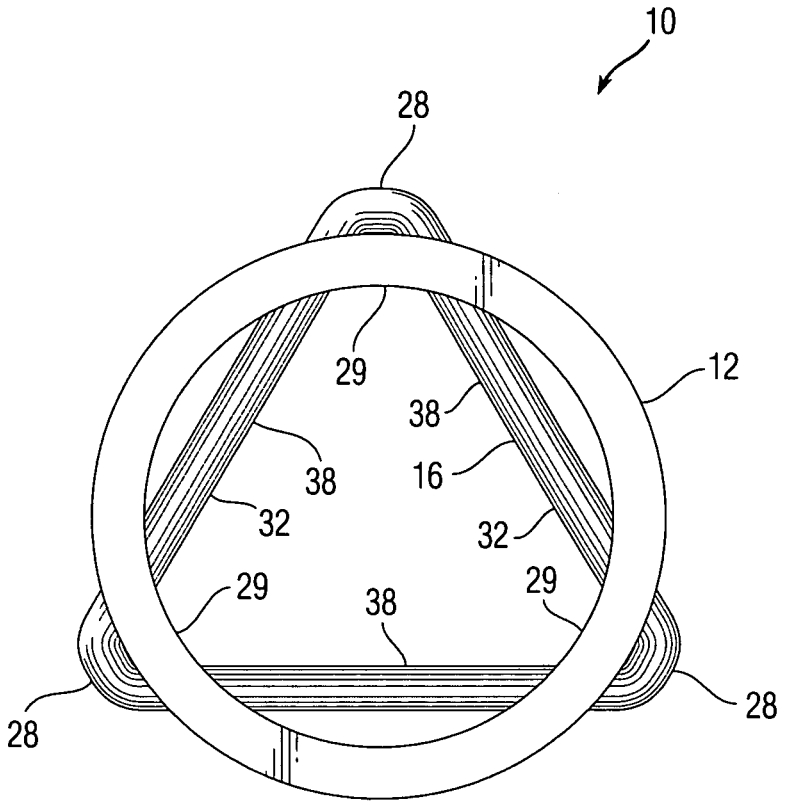
FIG. 9 is an end plan view of the O-ring Elastic Casing Article Holder.
Figure 10:
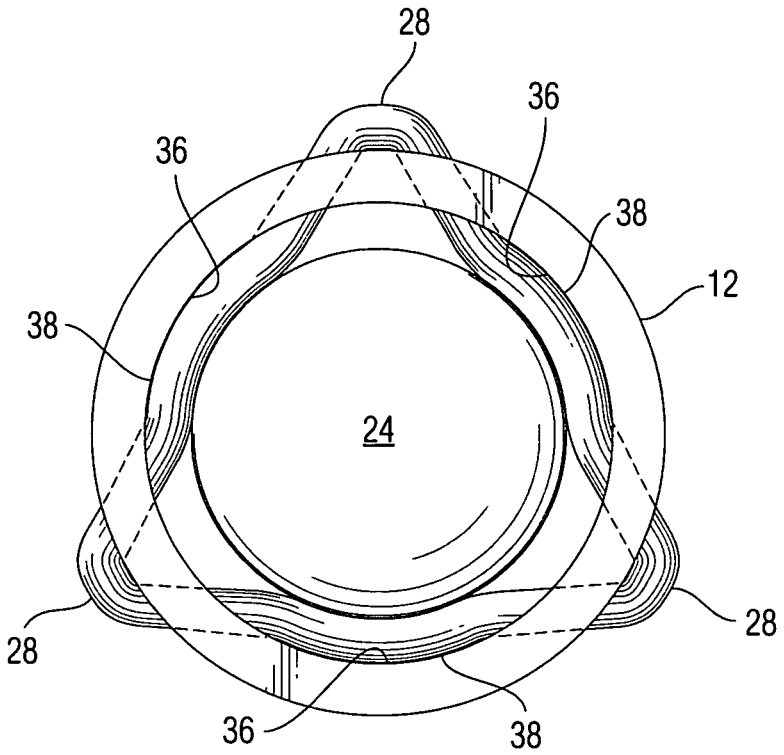
FIG. 10 is an end plan view thereof with the shank of a tool inserted therein.

Referring to FIGS. 1, 2, 5, 7, 9 and 10, the O-ring or elastic band utilizing embodiment of the Elastic Casing Article Holder 10 depends on three circumferential grooves 26 separated by shoulders 27 between the grooves 26 (FIG. 5). An O-ring or elastic band 16 is fitted into the three circumferential grooves 26 and over the shoulders 27 to thereby form an internal triangular configuration as shown in FIGS. 7, 9 and 10; and when the shank of a tool 24 is inserted into the elastic casing, the O-ring (elastic band) would form the configuration shown in FIG. 10. Note particularly in FIG. 7 that the shoulders 27 are 120°, 240° and 360° apart. When the grooves 26 along the length of the casing are filled with O-rings 16, the internal triangular configuration necessary to receive and hold the shank of a tool is attained (FIGS. 5, 9 and 10).

With reference to FIGS. 1, 2 5, 7, 9, and 10, the O-ring or band utilizing embodiment of the Elastic Casing Article Holder 10 utilizes O-rings or elastic bands 16 to grasp the rod or tool shaft 24 inserted into the cylinder 30. The cylinder 30 is made of Polyvinyl Chloride pipe and is machined with a series of parallel circular grooves 26 cut through the surface of the PVC cylinder 30. The cylinder is machined so that elastic bands 16 can be installed into the grooves 26 and over the shoulders 27 (FIG. 5) of the cylinder 30 and penetrate 32 to the inside of the cylinder as shown in the drawings (FIGS. 7, 9 and 10). The columns of parallel grooves 26 create channels, which when fitted with elastic bands or O-rings 16 grip an inserted rod or shaft of a tool 24 on three sides 36 (FIG. 10). The columns of elastic bands 16 create triangular opposing walls 38 within the cylinder and will exert equal pressure on the rod or tool shaft inserted therein (FIG. 10). Note particularly FIGS. 5, 7 and 10 show the columns of parallel grooves 26 and shoulders 27.

The circular elastic bands (O-rings), when fitted on the specially grooved 26 pipe-casing with shoulders 27, are subsequently reshaped and become triangular (FIGS. 7, 9 and 10). Each elastic band in triangular formation penetrates the pipe-casing and exerts equal lateral pressure on the shaft or rod when the shaft or rod 24 is inside the casing (FIG. 10). The elastic material in triangular formation exerts lateral and longitudinal pressure on the shaft or rod during insertion and removal of the tool. The reshaped elastic material also controls rotational motion. The pressure and friction are consistent because the reshaped O-rings 16 are malleable with exceptional memory. Linear force necessary to insert and remove shaft from casing is reduced if rotational force is simultaneously applied. The shaft 24 inserted in the O-ring elastic casing does not contact the pipe-casing (FIG. 10). The bands 16 (FIG. 5) which penetrate the interior of the pipe-casing provide balanced lateral force and push the shaft inserted away from the pipe-casing interior walls. The shaft floats in the casing. The center of the shaft or rod 24 is secured in the center of the casing (FIG. 10).

Attention is directed to FIGS. 7, 9, 10 and 11 where a portion of the O-ring 28 protrudes over shoulder 27 to retain an oversized pipe 64. Note also in FIG. 11 when tool shaft 24 is inserted into the article holder it distorts the triangular opposing walls 38 of the O-ring 16 on three sides 36 to securely hold the tool.

Figure 1:
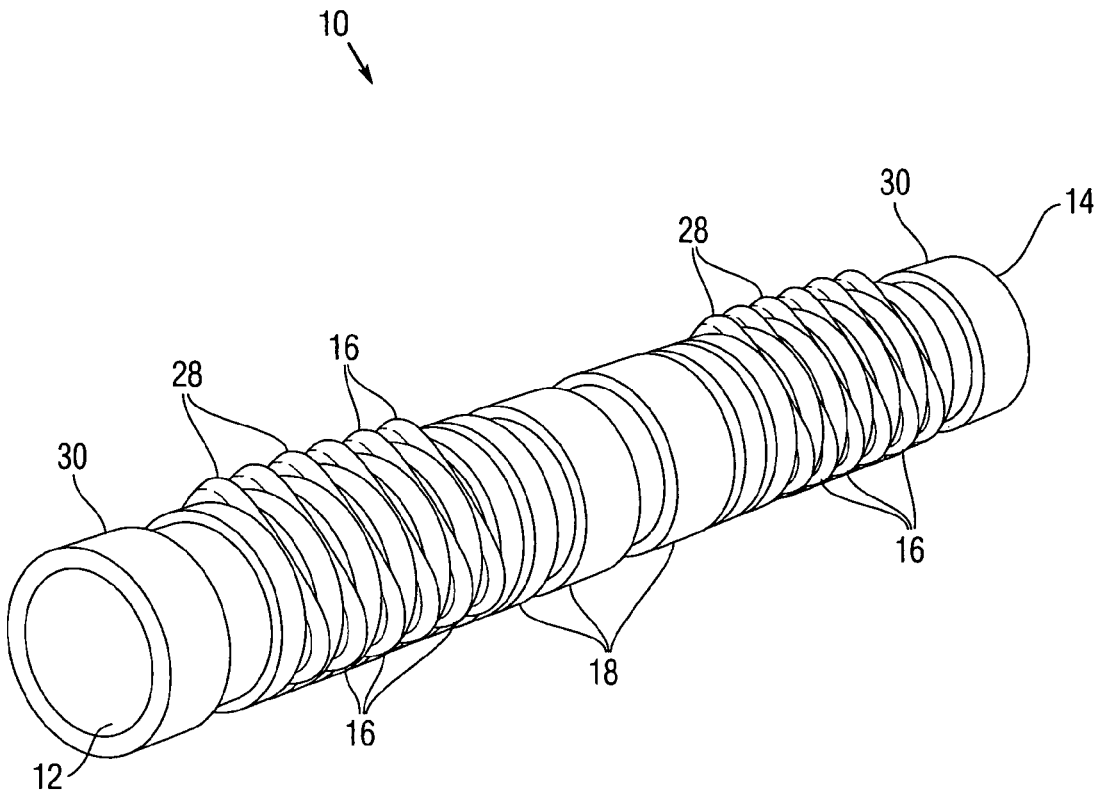
FIG. 1 is a perspective end view of the O-ring Elastic Casing Article Holder.
Figure 2:
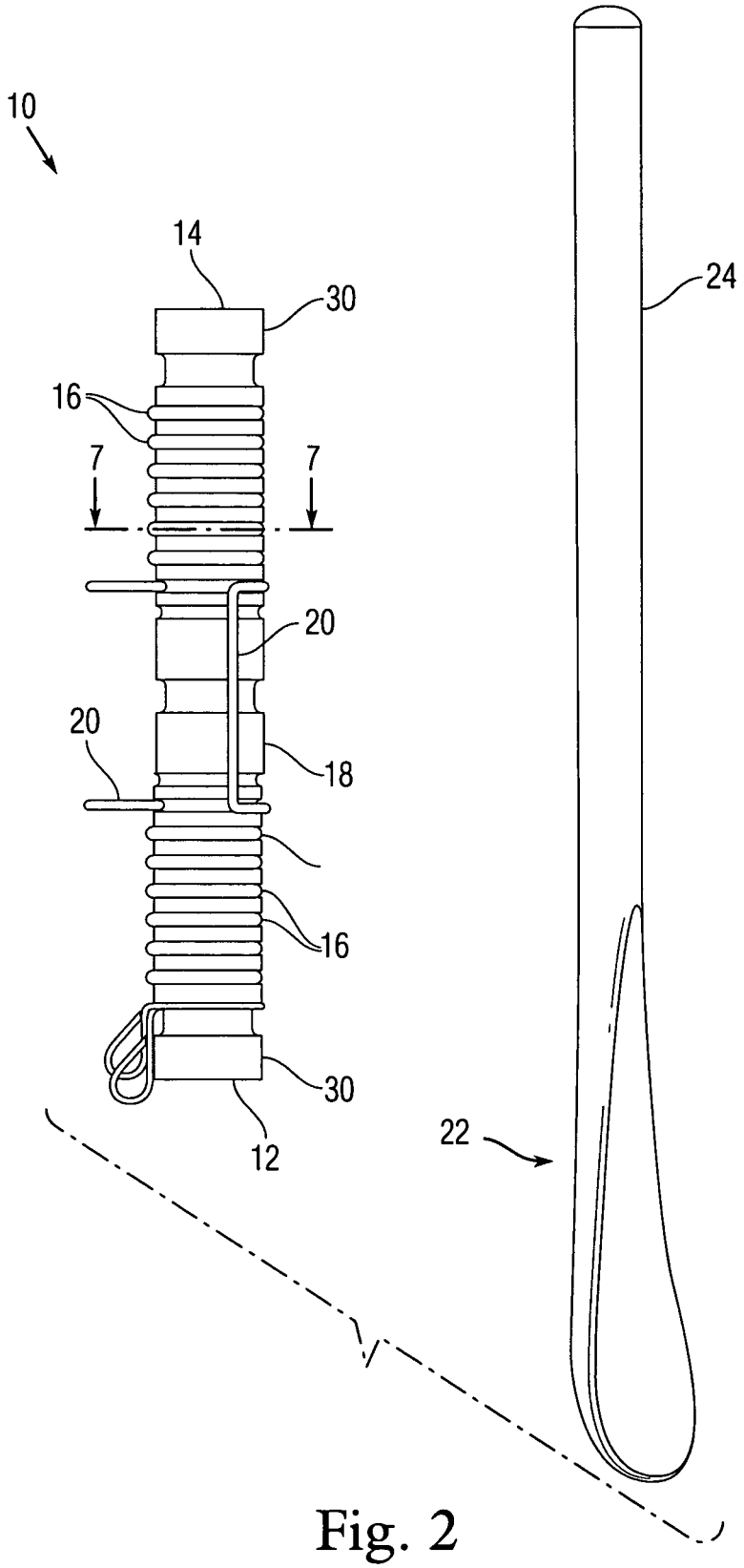
FIG. 2 is a top plan view thereof showing an article to be held.
Figure 13:
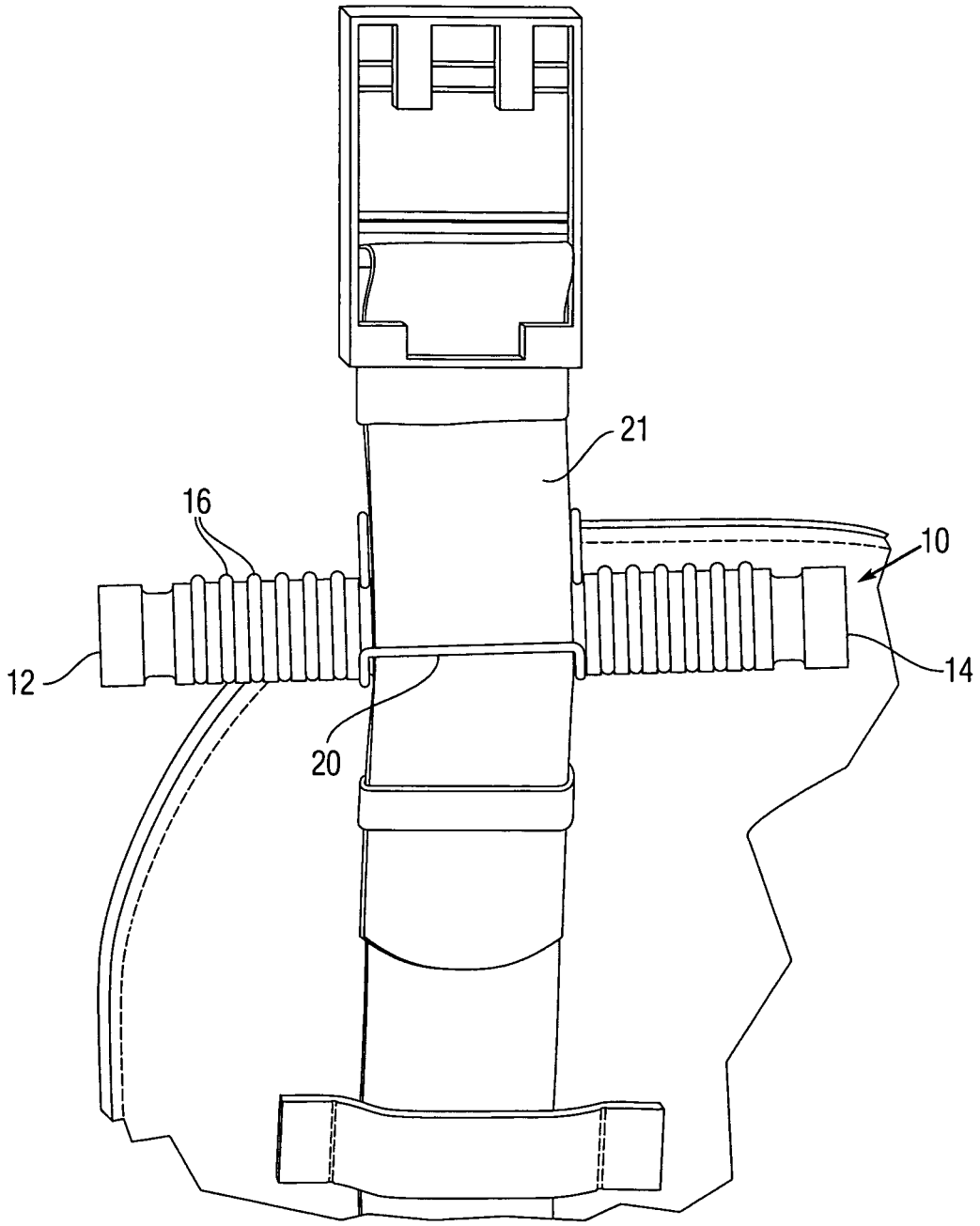
FIG. 13 is a view of the O-ring Elastic Casing Article Holder as it could be carried in a belt.
Figure 14:
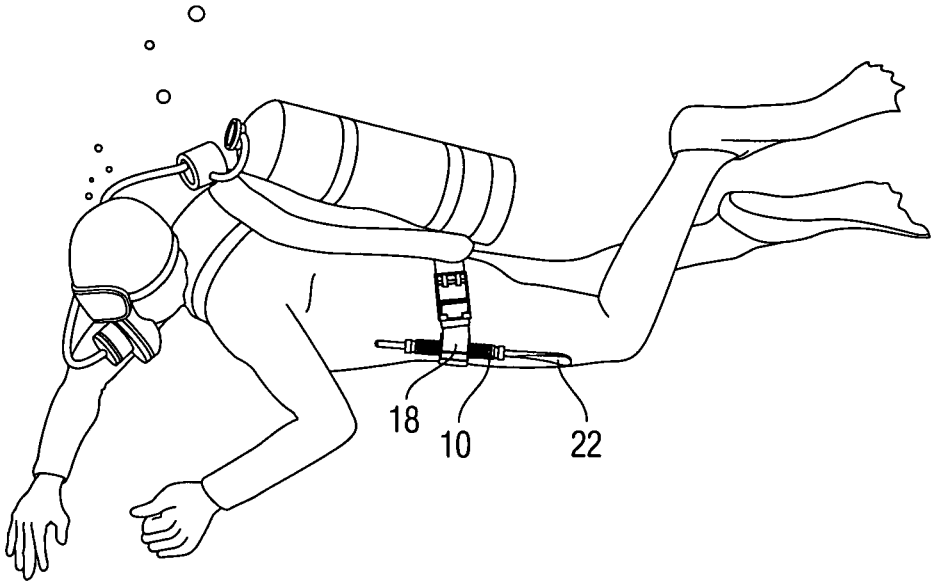
FIG. 14 is a pictorial view showing a scuba diver deploying an O-ring Elastic Casing Article Holder.

Note in FIGS. 2, 13 there is a clasp 20 designed to attach the Elastic Casing Article Holder 10 to belt 21.

Figure 8:
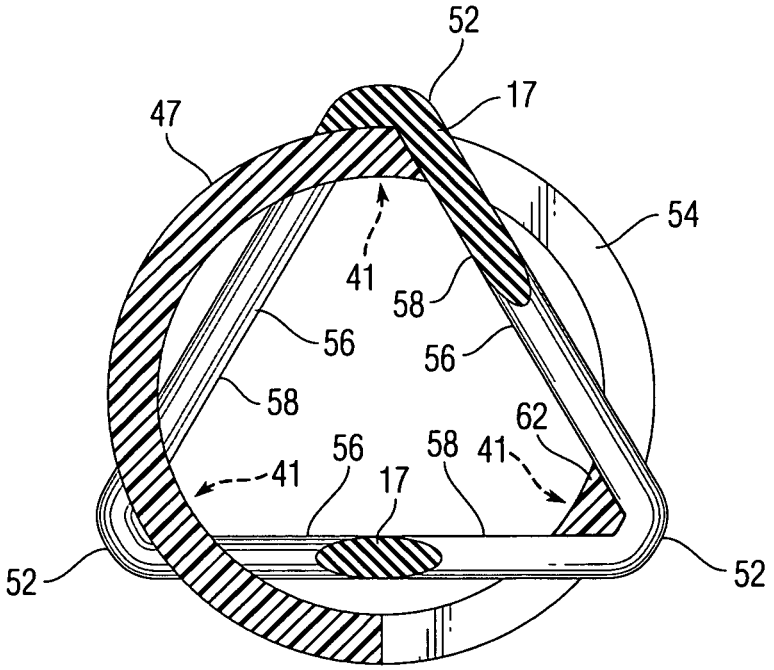
FIG. 8 is a cross-section along lines 8-8 of FIG. 4 to show the inner portion of the Helical Coil Elastic Casing Article Holder.

With reference to FIGS. 7 and 8 thatched lines 17 refer to elastic material and thatched lines 47 refers to plastic material.

Helical Coil-Utilizing Embodiment

Referring to FIGS. 3, 4, 6 and 8, the Helical Coil Elastic Casing Article Holder 40 embodiment of the invention depends on parallel helical grooves 50 separated by shoulders 62 running helically along the length of the casing 54 with the shoulders 62 separating the helical grooves 50. The shoulders 62 are positioned at 120°, 240° and 360° points around the casing 54 in FIG. 6. An elastic coil 46 is threaded with adequate tension along the helical grooves 50 to position the coil 46 into the grooves and into the interior 56 of the casing with the coil continuing with tension over the shoulders 62 separating the grooves to form the outward projection 52 of coil. As this wrapping process is continued, internal triangular sides are formed 58 which triangular arrangement holds the shank of the tool, similar to the triangular arrangement of O-ring embodiment (FIG. 10). Note particularly that the shoulders 62 of the helical device are placed on the casing of the helical device at 120°, 240° and 360° points 41 to form the internal triangular configuration necessary to receive and hold the shank of a tool.

Figure 3:
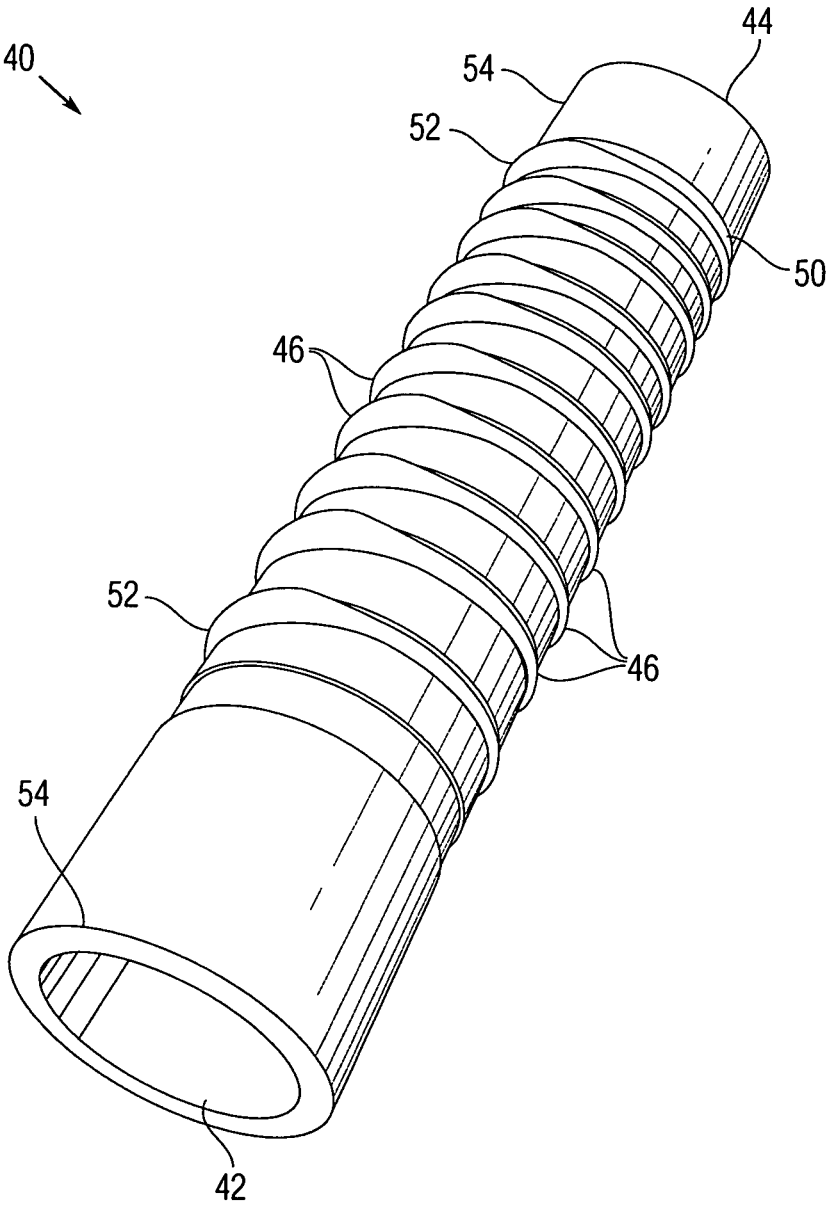
FIG. 3 is a perspective end view of a Helical Coil Elastic Casing Article Holder.
Figure 4:
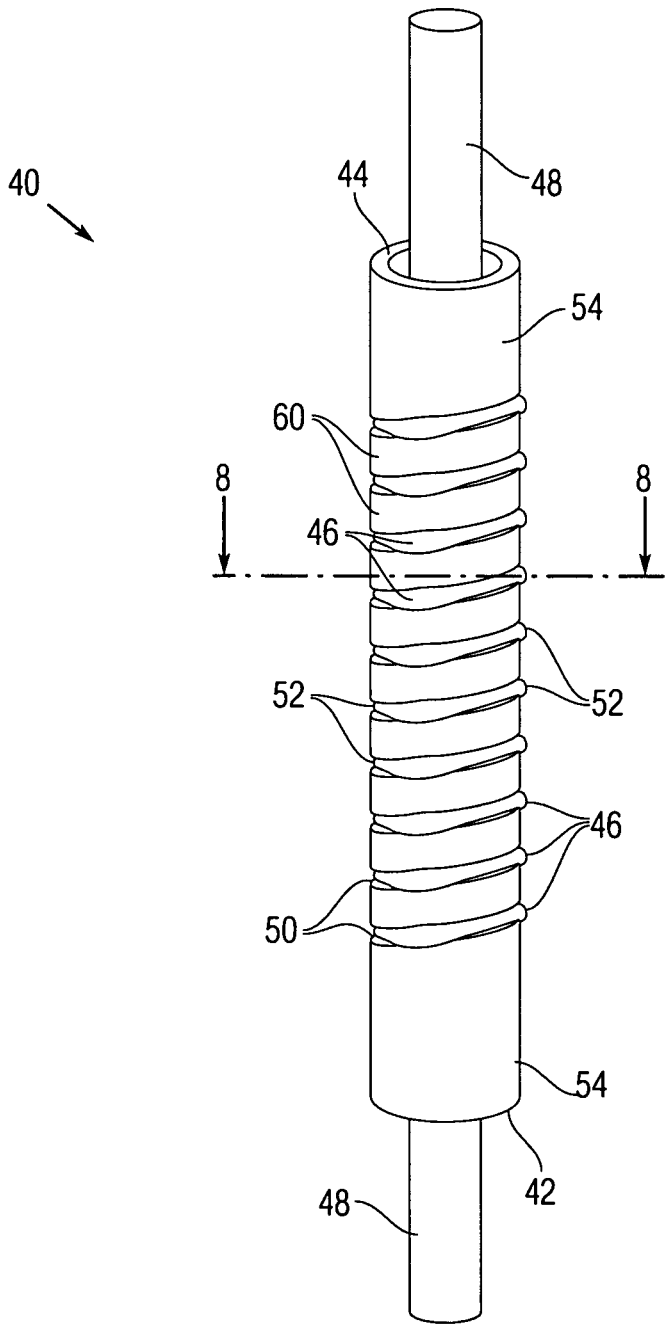
FIG. 4 is a top plan view thereof holding an article.

With reference to FIGS. 3, 4, 6 and 8, the Helical Coil Elastic Casing Article Holder 40 has many features common to the O-ring or band utilizing embodiment 10. Both embodiments embrace a tool holding device cylindrical in nature which holds the rod or shaft of a tool inserted into the cylinder 54. In the helical coil embodiment the cylinder utilizes an elastic coil 46 to grasp the rod 48 inserted into the cylinder 54 made of Polyvinyl Chloride (PVC) pipe and is machined with a series of parallel helical grooves 50 cut through the surface of the PVC pipe or cylinder 54. The cylinder 54 is machined so that a continuous elastic coil 46 can be wrapped around the cylinder 54 and penetrates 56 to the inside of the casing through shoulders 62 joining parallel channels 50 cut within the casing 54 which when laced with the elastic latex coil 46 grip an inserted rod or shaft 48 of a tool on three sides 58 (FIGS. 4 and 8). Note particularly that the three columns of elastic material create triangular opposing walls within the pipe casing which will exert equal pressure on the rod 48 inserted therein. This embodiment will be explained in greater detail below with reference to the drawings.

With reference to FIGS. 7 and 8, thatched lines 17 refer to elastic material and thatched lines 47 refer to plastic material.

The shaft 48 inserted in the Helical Coil Elastic Casing 40 does not contact the pipe-casing. The coil 46 which penetrates the interior of the pipe-casing provides balanced lateral force and pushes the shaft inserted away from the pipe-casing interior walls. The shaft floats in the casing. The center of the shaft or rod 48 is secured in the center of the casing 54 (FIGS. 3, 4, 6, 8 and similarly FIG. 10).

Referring to FIGS. 3, 4, 6 and 8, the band of latex tubing 46 penetrates the casing wall 54 by means of grooves arranged in helical form 50 so that the band can be continuous. This design economically maximizes the overall length of elastic material and therefore maximizes gripping pressure and friction. This is a significant innovation.

The elastic material 46 in helical formation exerts lateral pressure on the shaft or rod 48 of a tool when the shaft or rod is inside the casing. The elastic material in helical formation also exerts lateral and longitudinal pressure on the shaft or rod during insertion and removal of the tool. The pressure and friction are consistent because the helical flexible band is malleable with exceptional memory.

Figure 12:
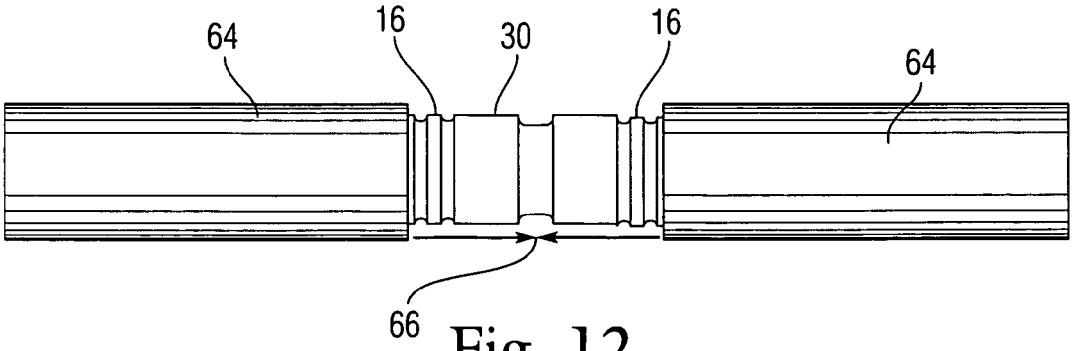
FIG. 12 is a view showing how the O-ring Elastic Casing Article Holder would hold two pieces of tubing prior to joining the tubing.

As an important feature of this invention, the elastic material coiled 46 around the outside of the pipe-casing and over the shoulder 62 that does not penetrate 52 the interior of the pipe-casing 54 also has potential malleable holding pressure and friction (FIGS. 3 and 4). A pipe-casing machined with three columns of grooves and fitted with elastic material will produce interior triangular opposing walls (FIGS. 3, 4, 6 and 8). This fitting of elastic material around such a grooved pipe-casing also symmetrically positions exterior elastic material 52 (FIGS. 3 and 4). With reference to FIG. 12, Helical Coil Elastic Casing 40 when inserted in another appropriate size pipe-casing 62 will have balanced pressure on the exterior of the casing 40. The casing 40 (inner casing) will be held in the center of the additional outer pipe-casing 62 (FIG. 12). This is also an important innovation of the device. The interior of such an outer casing can be indented or notched to engage these exterior malleable segments.

The triangular shaped walls of the Helical Coil Elastic Casing (FIGS. 4, 6 and 8) are malleable segmented threads which spiral along the interior of the pipe casing. A rod or shaft which has helical ridges or is screw-shaped can be rotated to be secured in the helical coil of the compression casing.

O-Ring and Helical Embodiments

The O-ring and helical embodiments have features in common. O-ring 16 and latex tubing 40 are an effective elastic material. A PVC pipe-casing 30, 54 is machined with a series of grooves of circular 26 or helical 50 formation (FIGS. 1-10). A casing 30, 54 is cut so that an O-ring 16 or continuous elastic coil 46 can be coiled around the casing and penetrates the interior of the casing 1. The grooves 26, 60 are segmented using shoulders 27, 62 so as to maintain the integrity of the pipe-casing 30, 54.

With reference to FIGS. 1-10, a cylinder 30, 54 is used to hold a rod or shaft of a tool 24, 48 inserted in the cylinder 30, 54. The tool 22 can be inserted at either end 12, 42; 14, 44 of the cylinder. The cylinder 30, 54 utilizes an elastic band 16 or coil 46 to grasp the rod 24, 48 inserted therein. A rigid casing 30, 54 and an elastic band 16 or coil 46 winding material are primary components of the device. There are no clasps or snaps to secure the rod in the casing 30, 54. The device 10, 40 has no cap or latch to hold the rod. The rod 24 inserted is secured only by the elastic band 16 or coils 46.

The compression casing can be constructed using economical readily-available materials. The device, therefore, can be connected by various methods to other materials. Since a rod or shaft can pass through the device, the O-ring or coiled compression casing can be a section or stage in an assembly or series of few or many parts. The triangular-shaped walls of the interior of the casing are malleable segments of elastic material which are spaced along the interior of the pipe-casing (FIGS. 5, 6, 9 and 10). Therefore, a rod or shaft that is indented or notched can engage these malleable interior segments.

Figure 11:
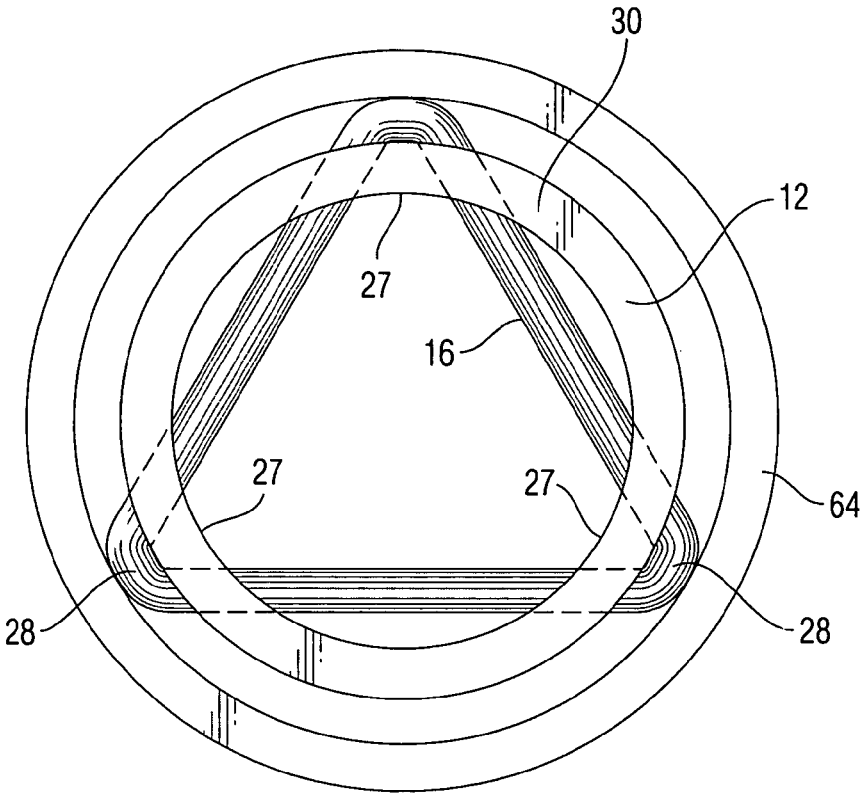
FIG. 11 is an end plan view of the O-ring Elastic Casing Article Holder showing both the O-ring Elastic Casing Article Holder and oversize outer tubing.

Attention is directed to FIGS. 10, 11 and 12 which show a unique embodiment of this invention. FIG. 10 shows that the Elastic Casing Article Holder is able to receive an article within the O-ring triangular arrangement. FIG. 11 shows an oversize tube 64 placed over the Elastic Casing Article Holder and held in place by the outward projections 29 of the elastic band 16. FIG. 12 shows two pieces of oversize tubing 64 inserted over the ends of the Elastic Casing Article Holder, with the arrows 66 showing the direction in which the tubing 64 is to be pushed for alignment prior to joining. The diameter of the casing can be adapted to the diameter of the rod to be inserted.

The formation of grooves for O-rings can be skewed or elliptical. Length of casing, length of grooves and number of grooves can be adapted to increase or decrease gripping force. The casing of the device can be minimal in length, such as a grommet or ring with only one elastic band or the casing can be elongated using several elastic bands. Width of grooves and size and type of elastic material can be altered for various applications. There can be less than three or more than three columns of grooves cut in casing of elongated device. There can be less than three or more than three grooves cut in grommet or ring casing. Cylindrical casing is practical, however, casing with a different profile such as square, can be used. The Elastic Casing Article Holder can be fabricated so as to produce minimal or no gripping force. The elastic material in this embodiment would only control lateral motion and therefore function as a spacer or cushion. The casing can be flexible and bendable. The pipe-casing can be split or segmented longitudinally so as to accommodate various thicknesses of shafts to be inserted. A split or segmented pipe-casing can be installed around a shaft.

Grommet or Bushing Embodiment

Figure 15:
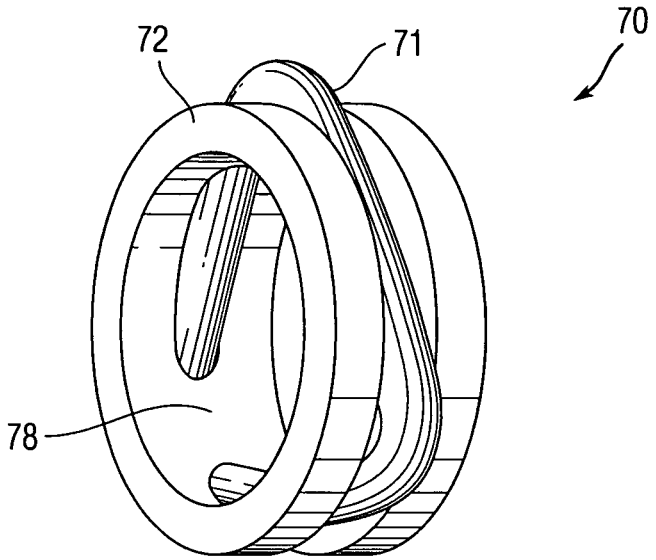
FIG. 15 is a perspective view of the elemental form of a single set of grooves and shoulders with an O-ring retained therein to form a grommet or bushing.
Figure 16:
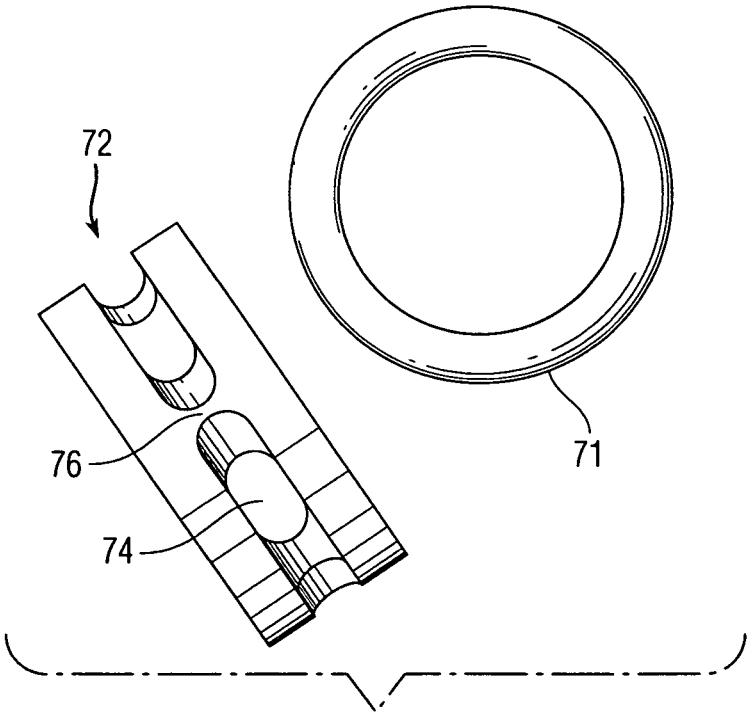
FIG. 16 is a perspective view of the components which make the grommet or bushing.

Referring to FIGS. 15 and 16, there are views of a grommet 70 wherein the elemental unit 72, namely the three grooves 74 and the three shoulders 76 of the O-ring Elastic Casing Article Holder 10 are used to make a grommet. See for example FIG. 5 where lines 16-16 show the area from which the elemental unit or grommet base 72 can be taken. Note also O-ring washer 71 which is inserted into grooves 74 and over shoulders 76, with the backside of the shoulder 78 shown in FIG. 15.

The outer elastic portion of the grommet as described by this invention can, for example, be fitted into a hole cut in wood or other material to allow for a protective fit of wires or piping passing through the inner portion of the grommet.

SUMMARY OF THE INVENTION

Said another way this invention involves a holder for the shank of a tool comprising a tubular sleeve having a series of parallel shoulders and circular grooves therein, which grooves are open to the inside of the tubular sleeve and which the grooves and shoulders allow a portion of an O-ring to protrude inwardly and outwardly to provide a means to hold the shank of a tool when the tool shank is inserted into the tubular sleeve, wherein the tool can be inserted easily at either end of the tubular sleeve and the tool can be easily removed. An oversize tubular implement can be placed over and held by the portion of the O-ring which protrudes outwardly. There are units of three shoulders and circular grooves in the tubular sleeve which is made of plastic. In use, an oversize tubular implement can be placed over each end of the holder and held by portions of the O-ring which protrudes outwardly, so that the oversize tubular implement placed over each end can be joined together.

In another embodiment, a holder for the shank of an implement involves a tubular sleeve having shoulders and helical grooves formed therein, with an elastomeric coil wound over the shoulder and within the helical grooves and partially protruding inwardly and partially outwardly thereof, such that the inwardly protruding elastomeric ribbon grips the shank of the implement and retains the shank of the implement within the sleeve and coil such that the implement may be slid outwardly of the sleeve by a manual force, and the tubular sleeve being able to receive the implement from either end. With the holder, an oversize tubular implement can be placed over and held by the portion of the elastomeric coil protruding outwardly. In the holder there are units of three sets of shoulders and parallel helical grooves in the tubular sleeve. As a further feature the holder can have an oversize tubular implement placed over each end of the holder and held by a portion of the coil which protrudes outwardly, so that the oversize tubular implement placed over each end can be joined.

An elemental unit of the O-ring embodiment can be used to form a grommet or bushing.

ADVANTAGES OF THE INVENTION

The invention controls lateral, linear and rotational motion. A shaft, rod or pipe inserted is therefore retained in device and can be easily removed and reinserted.

The device is useful when working in extreme environments such as underwater, underground and high altitudes.

The device is particularly useful in scuba diving where body positions constantly vary.

There are various methods to attach a coiled compression casing to the body or equipment of a person involved with sports activities.

The elastic gripping material is flexible and has a memory; therefore, a rod or shaft inserted into the casing for holding can be removed and easily reinserted.

A rod or shaft can be inserted at either end of the casing. This is important because of the varied positions of workers in hazardous environments.

The device can be used as a protective covering to shield threaded or specially machined pipe or rod.

The invention is suitable for military, tactical and rescue operations. Special tools can be carried and quickly accessed in an emergency.

The device is useful in robotics because it can be constructed using lightweight materials and the gripping tension is consistent in wet and dry environments and is thus useful for scientific research and recovery operations.

The Compression Casing can grip a rod or pipe inserted and simultaneously can be gripped by an outer pipe casing. This is also useful in applications of telescoping support.

The device can be used as a telescoping support mechanism in conjunction with a rod or shaft inserted. Especially in low gravity environments, the invention can be used to provide support and adjust position of instruments such as cameras and measuring devices and other implements.

The device can hold tools with smooth or irregular shafts. The rod or shaft can be indented or notched so as to engage elastic material.

The device can be used as a sleeve for protection of hydraulic hose, air hose and electric cable.

Various articles can be fastened to the exterior of the device so as to equip rope, hose and cable.

The device can be used as a shaft coupling to control vibration and sound.

The device can be used as an electric insulator.

The device can be used as a shaft or pipe coupling.

The device can be used to form a grommet, bushing or spacer.

The device can be fitted on pipe or shaft for emergency release and safety break-away.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A holder for the shank of a tool comprising a tubular sleeve having a series of parallel shoulders and circular grooves, wherein from the midpoint of the sleeve a plurality of said shoulders and grooves extend in each direction axially, and wherein said series of parallel shoulders and circular grooves contain O-rings which are spaced along the length of the tubular sleeve and wherein said circular grooves are open to the inside of the tubular sleeve and which the circular grooves and shoulders allow portions of the O-rings to protrude inwardly and outwardly to provide a means to hold the shank of a took when the tool shank is inserted into the tubular sleeve, wherein the tool can be inserted easily at either end of the tubular sleeve and the tool can be easily removed.

2. The holder of claim 1, wherein an oversize tubular implement can be placed over and held by the portion of the O-ring which protrudes outwardly.

3. The holder of claim 1, wherein there are units of three shoulders and circular grooves in the tubular sleeve.

4. The holder of claim 1, wherein the tubular sleeve is made of plastic.

5. The holder of claim 1, further comprising an oversize tubular implement placed over each end of the holder and held by portions of the O-ring which protrudes outwardly, so that the oversize tubular implement placed over each end can be joined.

6. A holder for the shank of an implement, comprising a tubular sleeve having shoulders and helical grooves formed therein, and an elastomeric coil wound over the shoulder within the helical groove and partially protruding inwardly and partially outwardly thereof, such that the inwardly-protruding elastomeric coil grips the shank of the implement and retains the shank of the implement within the sleeve, and such that the implement may be slid outwardly of the sleeve by a manual force, and the tubular sleeve being able to receive the implement from either end.

7. The holder of claim 6, further comprising an oversize tubular implement placed over and held by the portion of the elastomeric coil protruding outwardly.

8. The holder of claim 6, wherein there are units of three sets of shoulders and parallel helical grooves in the tubular sleeve.

9. The holder of claim 6, wherein the tubular sleeve is made of plastic.

10. The holder of claim 6, further comprising an oversize tubular implement placed over each end of the holder and held by a portion of the coil which protrudes outwardly, so that the oversize tubular implement placed over each end can be joined.

* * * * *